US005718414A

United States Patent [19]

Deloach et al.

[11] Patent Number: 5,718,414

[45] Date of Patent: Feb. 17, 1998

[54] LIGHTWEIGHT PORTABLE FENCING SYSTEM

[76] Inventors: Bobby Derene Deloach; Charleen Deloach, both of 11526 Monument Lake Cir., Jacksonville, Fla. 32225

[21] Appl. No.: 728,964

[22] Filed: Oct. 11, 1996

[51] Int. Cl.[6] ..... E04H 17/06

[52] U.S. Cl. ..... 256/24; 256/47; 256/73

[58] Field of Search ..... 256/24, 45, 47, 256/73, DIG. 5

[56] References Cited

U.S. PATENT DOCUMENTS

| | | | |
|---|---|---|---|
| 606,527 | 6/1898 | Feltenberger | 256/73 X |
| 609,685 | 8/1898 | Leonard | 256/73 X |
| 1,284,569 | 11/1918 | Bikowski | 256/24 X |
| 2,074,688 | 3/1937 | Friend | 256/73 X |
| 2,152,816 | 4/1939 | Olson | 256/24 |
| 3,347,527 | 10/1967 | Andrews | 256/24 X |

FOREIGN PATENT DOCUMENTS

| | | | |
|---|---|---|---|
| 5-106371 | 4/1993 | Japan | 256/24 |
| 6-158915 | 6/1994 | Japan | 256/73 |
| 8400058 | 8/1985 | Netherlands | 256/24 |

*Primary Examiner*—Anthony Knight

[57] ABSTRACT

A lightweight portable fencing system comprises a plurality of support panels each being formed in a planar configuration with a top edge, a bottom edge and two side edges, each of the side edges including coupling devices; and a plurality of support poles each being formed in a generally cylindrical configuration, each pole having a lower end formed as a large screw, each pole being rotated to secure its lower end within the ground, each support pole including coupling devices extending therefrom in a diametrically opposing orientation, each panel being positioned between two poles with the coupling devices of the poles and panels secured together, in an operative orientation the poles and panels of the apparatus being positioned vertically and arranged in a rectangular configuration.

2 Claims, 3 Drawing Sheets

LIGHTWEIGHT PORTABLE FENCING SYSTEM

BACKGROUND OF THE INVENTION

1. Field of the Invention

The present invention relates to a lightweight portable fencing system and more particularly pertains to enabling users to easily transport a fence for the purpose of containing pets and children.

2. Description of the Prior Art

The use of portable fences is known in the prior art. More specifically, fences heretofore devised and utilized for the purpose of surrounding structures are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,402,988 to Eisele discloses a portable fence.

U.S. Pat. No. 5,184,800 to Tabler discloses a portable snow fence system.

U.S. Pat. No. 4,083,535 to Britt discloses a portable fence.

U.S. Pat. No. 5,180,143 to Brower discloses a portable sport boundary fence.

U.S. Pat. No. 3,940,113 to Hirsch discloses a portable fence.

U.S. Pat. No. 350.648 to Gabriel-Lacki et al. discloses a collapsible portable child's play-pen.

While these devices fulfill their respective, particular objective and requirements, the aforementioned patents do not describe a lightweight portable fencing system to enable users to easily transport a fence for the purpose of containing pets and children.

In this respect, the lightweight portable fencing system according to the present invention substantially departs from the conventional concepts and designs of the prior art, and in doing so provides an apparatus primarily developed for the purpose of enabling users to easily transport a fence for the purpose of containing pets and children.

Therefore, it can be appreciated that there exists a continuing need for new and improved lightweight portable fencing system which can be used for enabling users to easily transport a fence for the purpose of containing pets and children. In this regard, the present invention substantially fulfills this need.

SUMMARY OF THE INVENTION

In the view of the foregoing disadvantages inherent in the known types of portable fences now present in the prior art, the present invention provides an improved lightweight portable fencing system. As such, the general purpose of the present invention, which will be described subsequently in greater detail, is to provide a new and improved lightweight portable fencing system and method which has all the advantages of the prior art and none of the disadvantages.

To attain this, the present invention essentially comprises a new and improved lightweight portable fencing system comprising, in combination: a plurality of support panels and a gate panel, each panel being formed in a generally rectangular configuration with a top edge, a bottom edge and two side edges, each panel having an upper region including a generally rectangular shaped aperture defining a window, each window spanning about seventy percent of the height and about ninety percent of the width of each panel, each panel being fabricated of sturdy fabric, the gate panel having a width measuring about seventy percent of the width of the support panels, each of the side edges including a plurality of circular holes extending therethrough, a plurality of eyelets being coupled around each of the circular apertures, a screen being fabricated of tight weave mesh and positioned within the window of each support panel; a plurality of support poles and two linking poles, each pole being fabricated of aluminum and formed in a generally cylindrical configuration, each pole having an upper end including a releasably couplable cap and a lower end formed as a large screw, each pole being rotated to secure its lower end within the ground, each support pole including a plurality of J-shaped hook pairs extending radially therefrom in a diametrically opposing orientation, each linking pole including a plurality of J-shaped hooks extending radially therefrom in a vertically aligned orientation, each linking pole further including a U-shaped receiving loop positioned adjacent the upper and lower ends thereof opposite the J-shaped hooks, the panels being positioned between two poles with the eyelets coupled around the J-shaped hooks of the poles; and a gate assembly comprising two gate poles and the gate panel, each gate pole being fabricated of aluminum and formed in a generally cylindrical configuration with a top end including a cap and flat bottom end, each gate pole including a plurality of J-shaped hooks extending radially therefrom in a vertically aligned orientation, each gate pole further including an L-shaped projection member extending downwardly therefrom adjacent the upper and lower ends of each gate pole, the gate panel being positioned between the gate poles with the eyelets being coupled around the J-shaped hooks of the poles, in an operative orientation the poles and panels of the apparatus being positioned vertically and arranged in a rectangular configuration, the linking poles being positioned opposite each other separated by a distance sufficient to couple the gate assembly therebetween, the gate assembly being couplable between the two linking poles by lowering the L-shaped projection members of the gate poles into the receiving loops of the linking poles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lightweight portable fencing system which has all the advantages of the prior art portable fences and none of the disadvantages.

It is another object of the present invention to provide a new and improved lightweight portable fencing system which may be easily and efficiently manufactured and marketed.

It is a further object of the present invention to provide a new and improved lightweight portable fencing system which is of durable and reliable construction.

An even further object of the present invention is to provide a new and improved lightweight portable fencing system which is susceptible of a low cost of manufacture with regard to both materials and labor, and which accordingly is then susceptible of low prices of sale to the consuming public, thereby making such a lightweight portable fencing system economically available to the buying public.

Even still another object of the present invention is to provide a new and improved lightweight portable fencing system for enabling users to easily transport a fence for the purpose of containing pets and children.

Lastly, it is an object of the present invention to provide a new and improved lightweight portable fencing system comprising: a plurality of support panels each being formed in a planar configuration with a top edge, a bottom edge and two side edges, each of the side edges including coupling devices; and a plurality of support poles each being formed in a generally cylindrical configuration, each pole having a lower end formed as a large screw, each pole being rotated to secure its lower end within the ground, each support pole including coupling devices extending therefrom in a diametrically opposing orientation, each panel being positioned between two poles with the coupling devices of the poles and panels secured together, in an operative orientation the poles and panels of the apparatus being positioned vertically and arranged in a rectangular configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
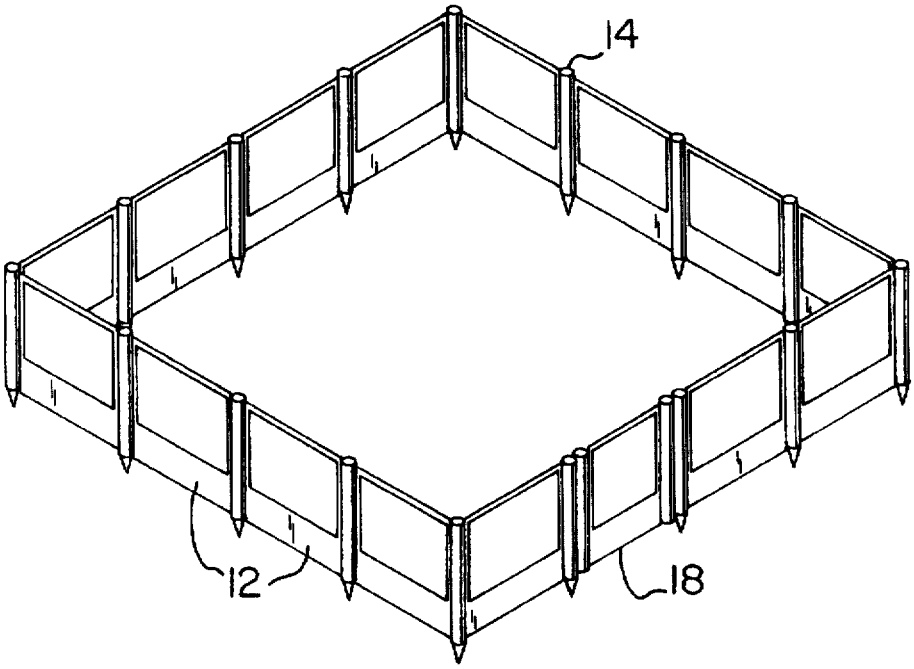
FIG. 1 is a perspective view of the preferred embodiment of the lightweight portable fencing system constructed in accordance with the principles of the present invention.

With reference now to the drawings, and in particular, to FIG. 1 thereof, the preferred embodiment of the new and improved lightweight portable fencing system embodying the principles and concepts of the present invention and generally designated by the reference number 10 will be described.

Specifically, it will be noted in the various Figures that the device relates to a lightweight portable fencing system 10. In its broadest context, the device consists of support panels 12, support poles 14 and a gate assembly 16. Such components are individually configured and correlated with respect to each other so as to attain the desired objective.

Figure 2:
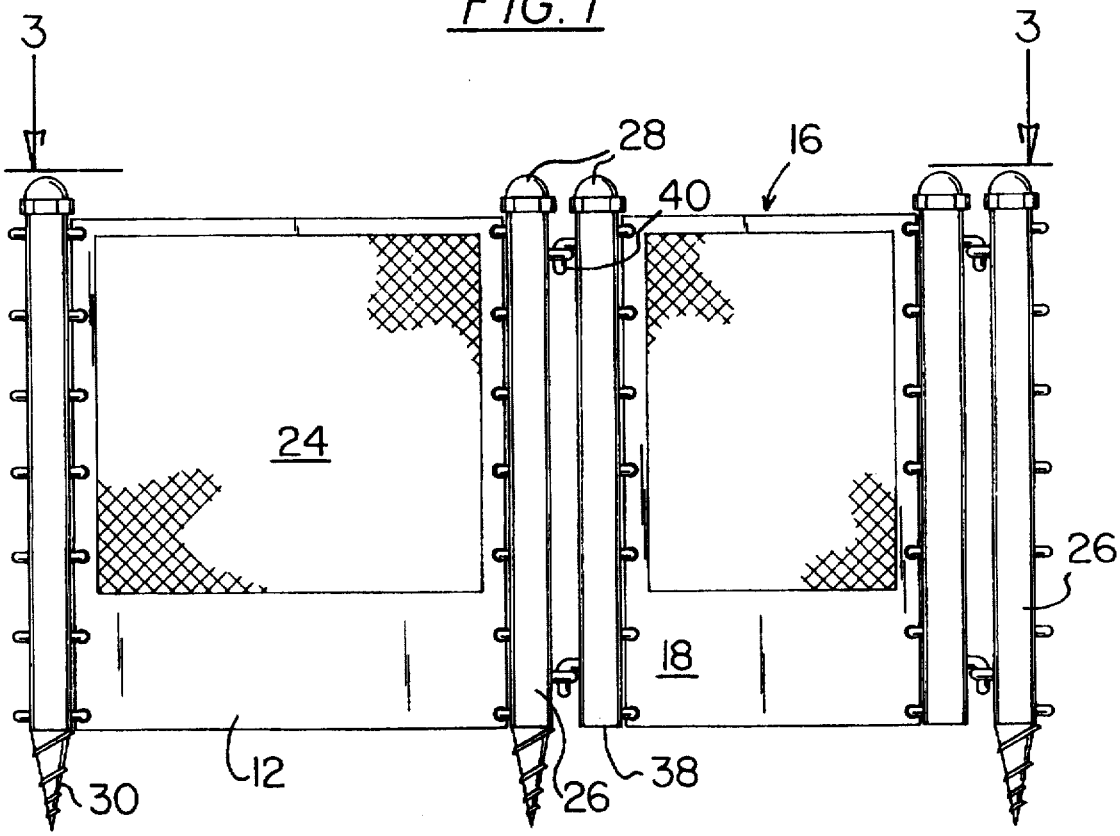
FIG. 2 is a front perspective view illustrating a panel and the door of the apparatus.
Figure 3:
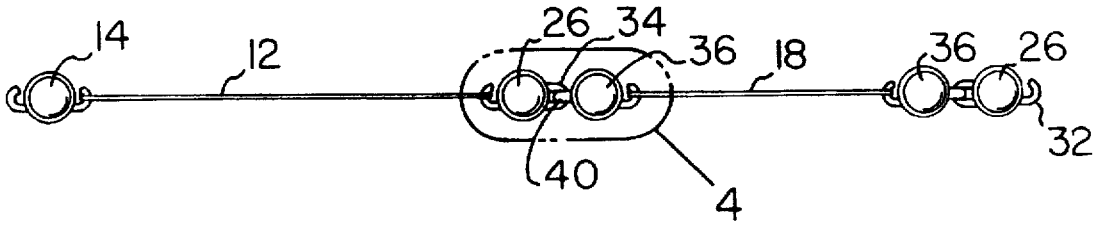
FIG. 3 is a top perspective view illustrating the coupling means of the apparatus.
Figure 4:
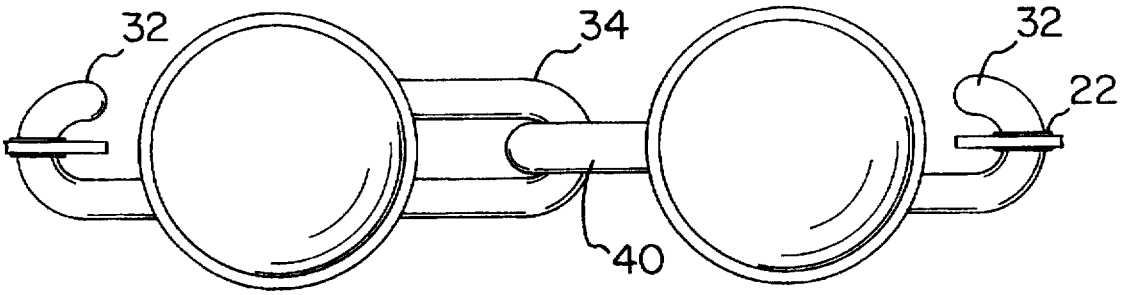
FIG. 4 is a enlarged perspective view of the coupling means illustrated in section line 4 of FIG. 3.
Figure 5:
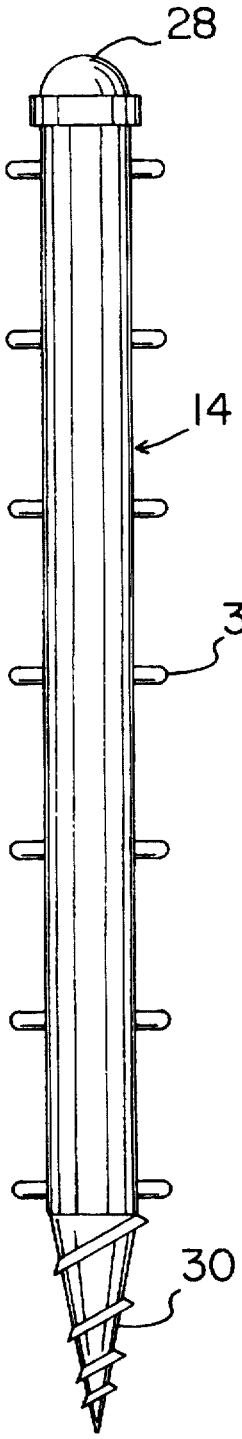
FIG. 5 is a perspective view of the support pole of the apparatus.
Figure 6:
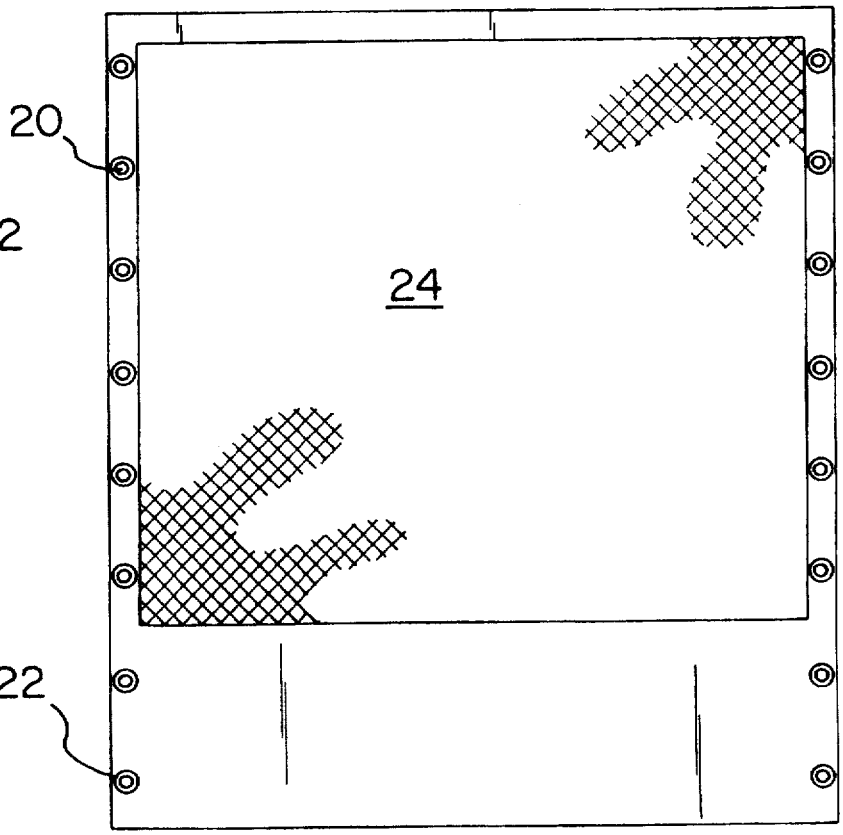
FIG. 6 is a perspective view of a single panel of the apparatus.

A plurality of support panels 12 and a gate panel 18 are included with the apparatus. Each of the panels 12, 18 are formed in a generally planar, rectangular configuration with a top edge, a bottom edge and two side edges. Each panel has an upper region which includes a generally rectangular shaped aperture defining a window. Each window spans about seventy percent of the height and about ninety percent of the width of each panel. In the preferred embodiment of the apparatus each panel is fabricated of sturdy fabric, such as nylon. The gate panel has a width which measures about seventy percent of the width of the support panels. Each of the side edges includes a plurality of circular holes 20 extending through them. In the preferred embodiment of the apparatus there are about seven holes through each side edge. A plurality of metal eyelets 22 are coupled around each of the circular apertures. The metal eyelets prevent tearing of the holes. A screen 24 is fabricated of tight weave mesh and positioned within the window of each support panel. The small weave of the screen prevents small children from getting their fingers caught in it. Additionally, the panels and screens may be washed to keep them clean and germ free. In alternative embodiments, the panels and screens may be fabricated in a variety of colors to suit the user's tastes. Note FIGS. 1, 2 and 6.

A plurality of support poles 14 and two linking poles 26 are included with the apparatus. Each pole is fabricated of aluminum and formed in a generally cylindrical configuration. Each pole has an upper end which includes a releasably couplable cap 28 and a lower end which is formed as a large screw 30. Each pole has a height between thirty six and forty eight inches. Each pole is rotated to secure its lower end within the ground. Each support pole includes a plurality of J-shaped hook pairs 32 extending radially from the pole in a diametrically opposing orientation. In the preferred embodiment about seven pairs of J-shaped hooks are attached to the pole. Each linking pole includes a plurality of J-shaped hooks 32 extending radially from it in a vertically aligned orientation. Each linking pole further includes a U-shaped receiving loop 34 which is positioned adjacent the upper and lower ends of the pole opposite the J-shaped hooks. The panels are positioned between two poles with the eyelets coupled around the J-shaped hooks of the poles. Note FIGS. 1–5.

The gate assembly comprises two gate poles 36 and the gate panel 18. Each gate pole is fabricated of aluminum and formed in a generally cylindrical configuration with a top end including a cap and flat bottom end 38. The gate poles have a length shorter than the length of the support poles. Each gate pole includes a plurality of J-shaped hooks 32 extending radially from it in a vertically aligned orientation. The J-shaped hooks are aligned with the J-shaped hooks of the linking poles. Each gate pole further includes an L-shaped projection member 40 with a horizontally positioned upper section and a vertically positioned lower section. The L-shaped projection member 40 extends downwardly from the gate pole adjacent to its upper and lower ends. The gate panel 18 is positioned between the gate poles with the eyelets coupled around the J-shaped hooks of the poles. In an operative orientation the poles and panels of the apparatus are positioned vertically and arranged in a rectangular configuration. Various numbers of panels can be used to make the area enclosed by the apparatus larger or smaller. The linking poles are positioned opposite each other and separated by a distance sufficient to couple the gate assembly between them. The gate assembly is couplable between the two linking poles by lowering the L-shaped projection members of the gate poles into the receiving loops of the linking poles. Note FIGS. 3–4.

The current invention allows a user to utilize a single fencing system for pets and children. The apparatus could be used while camping or taking part in any outdoor activity. Children could be placed on one side of the fence and pets on the other. The current invention is easy to assemble and disassemble and provides a protective barrier for the user. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved lightweight portable fencing system comprising, in combination:

a plurality of support panels and a gate panel, each panel being formed in a generally rectangular configuration with a top edge, a bottom edge and two side edges, each panel having an upper region including a generally rectangular shaped aperture defining a window, each window spanning about seventy percent of the height and about ninety percent of the width of each panel, each panel being fabricated of sturdy fabric, the gate panel having a width measuring about seventy percent of the width of the support panels, each of the side edges including a plurality of circular holes extending therethrough, a plurality of eyelets being coupled around each of the circular apertures, a screen being fabricated of tight weave mesh and positioned within the window of each support panel;

a plurality of support poles and two linking poles, each pole being fabricated of aluminum and formed in a generally cylindrical configuration, each pole having an upper end including a releasably couplable cap and a lower end formed as a large screw, each pole being rotated to secure its lower end within the ground, each support pole including a plurality of J-shaped hook pairs extending radially therefrom in a diametrically opposing orientation, each linking pole including a plurality of J-shaped hooks extending radially therefrom in a vertically aligned orientation, each linking pole further including a U-shaped receiving loop positioned adjacent the upper and lower ends thereof opposite the J-shaped hooks, the panels being positioned between two poles with the eyelets coupled around the J-shaped hooks of the poles; and a gate assembly comprising two gate poles and the gate panel, each gate pole being fabricated of aluminum and formed in a generally cylindrical configuration with a top end including a cap and flat bottom end, each gate pole including a plurality of J-shaped hooks extending radially therefrom in a vertically aligned orientation, each gate pole further including an L-shaped projection member extending downwardly therefrom adjacent the upper and lower ends of each gate pole, the gate panel being positioned between the gate poles with the eyelets being coupled around the J-shaped hooks of the poles, in an operative orientation the poles and panels of the apparatus being positioned vertically and arranged in a rectangular configuration, the linking poles being positioned opposite each other separated by a distance sufficient to couple the gate assembly therebetween, the gate assembly being couplable between the two linking poles by lowering the L-shaped projection members of the gate poles into the receiving loops of the linking poles.

2. A lightweight portable fencing system comprising:

a plurality of support panels each being formed in a planar configuration with a top edge, a bottom edge and two side edges, each of the side edges including coupling devices, each of the side edges including a plurality of circular holes extending therethrough, a plurality of eyelets being coupled around each of the circular apertures; and a plurality of support poles and two linking poles, each pole being formed in a generally cylindrical configuration, each pole having a lower end formed as a large screw, each pole being rotated to secure its lower end within the ground, each support pole including coupling devices extending therefrom in a diametrically opposing orientation, each panel being positioned between two poles with the coupling devices of the poles and panels secured together, in an operative orientation the poles and panels of the apparatus being positioned vertically and arranged in a rectangular configuration; and a gate assembly comprising two gate poles and a panel, each gate pole being formed in a generally cylindrical configuration with a top end and a flat bottom end, each gate pole including a plurality of coupling devices and at least a plurality of L-shaped projection members extending radially and downwardly therefrom, the L-shaped projection members being adjacent the upper and lower ends of each gate pole and capable of being positioned between the gate poles with the coupling devices secured to the L-shaped projection members, the support poles being positioned opposite each other and separated by a distance sufficient to couple the gate assembly therebetween, the gate assembly being coupled between two support poles to permit entry and exit through the fence.

* * * * *